United States Patent [19]

Tanaka et al.

[11] Patent Number: 4,884,400

[45] Date of Patent: Dec. 5, 1989

[54] EXHAUST MANIFOLD OF INTERNAL COMBUSTION ENGINE

[75] Inventors: Yoshimasa Tanaka, Ayase; Yutaka Tasaki, Yokohama, both of Japan

[73] Assignee: Nissan Motor Co., Ltd., Japan

[21] Appl. No.: 167,086

[22] Filed: Mar. 11, 1988

Related U.S. Application Data

[63] Continuation of Ser. No. 801,696, Nov. 25, 1985, abandoned.

[30] Foreign Application Priority Data

Nov. 29, 1984 [JP] Japan ..... 59-181230[U]
Nov. 29, 1984 [JP] Japan ..... 59-181231[U]

[51] Int. Cl.[4] ..... F01N 7/10
[52] U.S. Cl. ..... 60/323
[58] Field of Search ..... 60/323, 322, 282

[56] References Cited

U.S. PATENT DOCUMENTS 2,078,754 4/1937 Day .
3,488,723 1/1970 Veazie ..... 60/323
3,703,083 11/1972 Tadokore .
3,799,196 3/1974 Scheitlin et al. .
3,807,173 4/1974 Zmuda ..... 60/282
3,948,295 4/1976 Lemont et al. .
3,949,552 4/1976 Kaneko et al. .
4,234,054 11/1980 Chapin .
4,408,679 10/1983 Littrell .
4,421,202 12/1983 Hoy .
4,598,790 7/1986 Uesugi et al. .

FOREIGN PATENT DOCUMENTS 56-37047 8/1981 Japan .
57-47713 3/1982 Japan .

*Primary Examiner*—Douglas Hart
*Attorney, Agent, or Firm*—Lowe, Price, LeBlanc, Becker & Shur

[57] ABSTRACT

Herein disclosed is an improved exhaust manifold for an internal combustion engine, which comprises an outer body of aluminium having a configuration corresponding to the exhaust manifold, and insulating layer of ceramic fiber disposed on the inner surface of the outer body for protecting the outer body from the heated exhaust gas, and a protecter incorporated with the insulating layer in a manner to maintain the disposition and configuration of the insulating layer.

3 Claims, 2 Drawing Sheets

EXHAUST MANIFOLD OF INTERNAL COMBUSTION ENGINE

This is a continuation of application Ser. No. 801,696 Nov. 25, 1985 now abandoned.

BACKGROUND OF THE INVENTION

1. Field of the Invention

The present invention relates to an exhaust manifold for an internal combustion engine, and more particularly to an exhaust manifold the inner surface of which is lined with a heat insulating material.

2. Description of the prior art

Hitherto, various kinds of exhaust manifolds have been proposed and put into practical use in the field of internal combustion engines. In order to reduce the weight, some of the exhaust manifolds are constructed of light metal, such as, aluminium or the like. When using aluminium as a material of the exhaust manifold, it becomes necessary to line the inner surface of the manifold with a heat insulating material because of the poor heat resistance of this metal.

Some of the hitherto proposed exhaust manifolds have employed a ceramic fiber layer as the liner. However, due to its inherent construction of the liner, prolonged use of this type of manifold tends to induce undesirable peel-off phenomenon of the inner surface of the ceramic fiber layer which is exposed to the highly heated exhaust gas emitted from the engine. Of course, this phenomenon induces thermal damage (such as melting or the like) of the aluminium body of the exhaust manifold. This undesirable phenomenon is particularly notable at the inlet ports of the manifold which are directly attached to the highly heated exhaust ports of the engine.

SUMMARY OF THE INVENTION

Therefore, it is an object of the present invention to provide an improved exhaust manifold which is free of the above-mentioned drawback.

According to the present invention, there is provided an exhaust manifold for conducting heated exhaust gas from an internal combustion engine, which comprises an outer body having a configuration which corresponds to that of the exhaust manifold, an insulating layer of ceramic fiber disposed on the inner surface of the outer body for protecting the outer body from the heat exhaust gas, and a member having a predetermined shape, the member being disposed with the insulating layer in a manner to maintain the disposition and configuration of the insulating layer.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
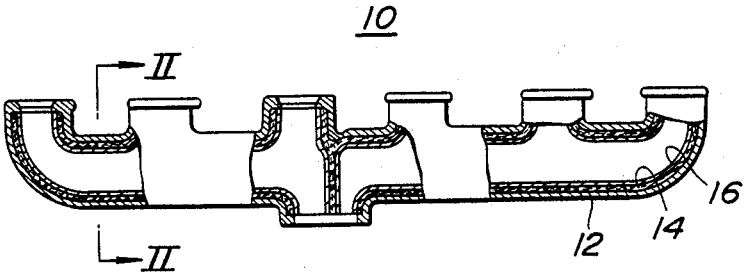
FIG. 1 is a partially sectional view of an exhaust manifold of a first embodiment of the present invention.
Figure 2:
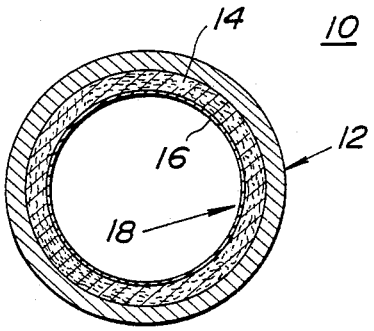
FIG. 2 is an enlarged sectional view taken along the line II—II of FIG. 1.

Referring to FIGS. 1 and 2, there is shown an exhaust manifold 10 of a first embodiment of the present invention. The exhaust manifold 10 comprises an outer body 12 of aluminium which serves as a structural base of the arrangement. The inner surface of the outer body 12 is lined with a layer 14 of ceramic fiber. The inner surface of the layer 14 is lined with a protecting layer 16 to form, as a whole, an inner body 18 of the manifold 10. The protecting layer 16 is constructed of a heat resisting perforated metal sheet, such as a wire mesh, perforated sheet or louvered sheet of steel.

Method of producing the above-mentioned exhaust manifold 10 is as follows:

First, a selected metal sheet is shaped to have a configuration which corresponds to that of the exhaust manifold 10. Then, the ceramic fiber 14 is applied to the outer surface of the shaped metal sheet 16 to form a monolithic inner body 18. For this ceramic fiber application, a so-called "sheet sticking method" or a so-called "vacuum molding method" may be employed. In the "sheet sticking method", small pieces of ceramic fiber sheet are impregnated with a binder (such as, silica-cement solution) and then stuck to the shaped metal sheet 16 putting on one another, while, in the "vacuum molding method", an inner mold made of metal wire net is immersed in a suspension of ceramic fiber and vacuum is applied to the interior of the mold to form a ceramic fiber layer on the mold, and then the ceramic fiber layer is dried and released from the mold and then bonded to the shaped metal sheet 16. The inner body 18 (which thus consists of the ceramic fiber sheet 14 and the shaped metal sheet 16) is placed in a suitable mold (not shown) and molten aluminium is poured into the mold and cooled. With this, the entire construction of the exhaust manifold 10 as shown in the drawings is obtained.

Experiment has revealed that the exhaust manifold 10, more particularly, the inner surface of the inner body 18 of the manifold 10 is prevented from peeling off even after long use thereof, unlike the case of the above-mentioned conventional exhaust manifold. Thus, the ceramic fiber sheet 14 retains its position and heat insulating function for a long time.

Figure 3:
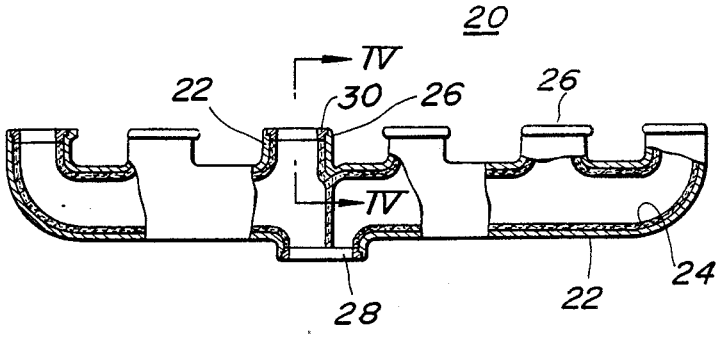
FIG. 3 is a view similar to FIG. 1, but showing a second embodiment of the present invention.
Figure 4:
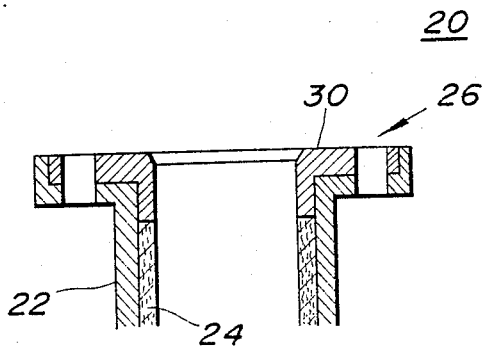
FIG. 4 is an enlarged sectional view taken along the line IV—IV of FIG. 3.

Referring to FIGS. 3 and 4, there is shown a second embodiment of the present invention. The exhaust manifold 20 of this second embodiment comprises an outer body 22 of aluminium which serves as a structural base of the arrangement. The inner surface of the outer body 22 is lined with a sheet 24 of ceramic fiber except the inner surface of a given portion where an extreme end of each flanged inlet or outlet port 26 or 28 is provided. As is seen from FIG. 4, the inner surface of the flanged port 26 or 28 is lined with a heat resisting steel layer 30.

In the following, method of producing the exhaust manifold 20 of the second embodiment will be described.

First, the sheet of ceramic fiber 24 is shaped to have a configuration which corresponds to that of the exhaust manifold 20. For this shaping, the afore-mentioned "vacuum molding method" is employed. Then, a flanged collar of heat resisting steel is bonded to the extreme end of each inlet or outlet port defined by the shaped ceramic fiber body. If desired, a collar without flange may be used in place of the flanged collar 30. Then, the inner body (which thus consists of the shaped ceramic fiber body 24 and the steel collar 30) is placed in a suitable mold (not shown) and molten aluminum is poured into the mold and cooled. With this, the entire construction of the exhaust manifold 20 is obtained.

Experiment has revealed that the undesirable peel-off phenomenon of the ceramic fiber which would be particularly notable at the inlet ports of the afore-mentioned conventional exhaust manifold does not occur in the exhaust manifold 20 according to the invention.

What is claimed is:

1. An exhaust manifold for conducting heated exhaust gas from an internal combustion engine and including at least one inlet or outlet port, comprising:

an outer body of aluminum having a configuration which corresponds to that of the exhaust manifold;

a heat resisting steel layer disposed on the inner surface of said outer body at said inlet or outlet port; and an insulating layer of ceramic fiber disposed on the inner surface of said outer body not covered by said heat resisting steel layer, said insulating layer protecting said outer body from the heated exhaust gas and said heat resisting steel layer maintaining the disposition and configuration of said insulating layer on the outer body.

2. An exhaust manifold as defined by claim 1, wherein the heat resisting steel layer is in the form of a collar member arranged at the end of said port.

3. An exhaust manifold as defined by claim 2, wherein said collar member includes a coaxial flange portion coaxially arranged on a corresponding flange portion of the outer body.

* * * * *